US008487860B2

(12) United States Patent
Yonemochi

(10) Patent No.: US 8,487,860 B2
(45) Date of Patent: Jul. 16, 2013

(54) CIRCUIT AND METHOD FOR DRIVING, ELECTRO-OPTIC DEVICE, AND ELECTRONIC APPARATUS

(75) Inventor: Akihiko Yonemochi, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 1004 days.

(21) Appl. No.: 12/366,161

(22) Filed: Feb. 5, 2009

(65) Prior Publication Data

US 2009/0231172 A1 Sep. 17, 2009

(30) Foreign Application Priority Data

Mar. 12, 2008 (JP) ..... 2008-062221

(51) Int. Cl.
*G09G 3/36* (2006.01)

(52) U.S. Cl.
USPC ..... 345/100; 345/89; 345/90; 345/98; 345/103

(58) Field of Classification Search
USPC ..... 345/30, 55, 84, 87, 92–98, 100, 204, 345/214, 103, 89–90; 327/103
See application file for complete search history.

(56) References Cited

U.S. PATENT DOCUMENTS

| | | | | |
|---|---|---|---|---|
| 6,160,534 | A * | 12/2000 | Katakura | 345/98 |
| 6,980,266 | B2 * | 12/2005 | Choi | 349/106 |
| 7,113,156 | B2 * | 9/2006 | Hashimoto | 345/77 |
| 2005/0259092 | A1 * | 11/2005 | Aoki | 345/204 |

FOREIGN PATENT DOCUMENTS

| | | | |
|---|---|---|---|
| JP | 5-150751 | A | 6/1993 |
| JP | 06-075204 | A | 3/1994 |
| JP | 07-013523 | A | 1/1995 |
| JP | 2000-056736 | A | 2/2000 |

* cited by examiner

*Primary Examiner* — Lun-Yi Lao
*Assistant Examiner* — Jarurat Suteerawongsa
(74) *Attorney, Agent, or Firm* — ALG Intellectual Property, LLC

(57) ABSTRACT

There is provided a driving circuit that drives an electro-optic device by outputting data signals that are subjected to serial-to-parallel conversion into m channels through m (m is a natural number greater than or equal to 2) image signal lines to a plurality of data lines. The driving circuit includes an adjusting section that adjusts the m-channel data signals so that, when a reference signal whose signal level is a reference level is input, the m-channel data signals at least partly reach signal levels different from the reference level for each channel, the number of continuous channels of signals at the same signal level is smaller than a predetermined number, and the differences between the signal levels and the reference level fall within a predetermined range.

9 Claims, 12 Drawing Sheets

CIRCUIT AND METHOD FOR DRIVING, ELECTRO-OPTIC DEVICE, AND ELECTRONIC APPARATUS

BACKGROUND

1. Technical Field

The present invention relates to a technical field of a driving circuit for driving, for example, a liquid-crystal display device and a method for the same, an electro-optic device equipped with the driving circuit, and an electronic apparatus, such as a liquid-crystal projector, equipped with the electro-optic device.

2. Related Art

Some of this type of driving circuit divides a data signal for displaying an image into a plurality of data signals to allow writing to multiple pixels. In such driving, difference in the characteristics of output circuits or the like may cause variations in the level of output data signals, thereby causing display irregularities. Thus, a technique for reducing the variations in signal level by calibrating the signal level of the output circuits during driving is disclosed (refer to JP-A-5-150751).

However, the above technique has a technical problem in that the circuit configuration is complicated because a circuit for executing calibration is mounted. This technique has another problem in that display irregularities cannot be reduced if an image display device itself has the cause of the display irregularities, even if calibration is executed to reduce variations in signal level.

SUMMARY

An advantage of some aspects of the invention is to provide a driving circuit and a method therefor, an electro-optic device, and an electronic apparatus in which display irregularities can be efficiently reduced with simple configuration.

According to a first aspect of the invention, there is provided a driving circuit that drives an electro-optic device by outputting data signals that are subjected to serial-to-parallel conversion into m channels through m (m is a natural number greater than or equal to 2) image signal lines to a plurality of data lines. The driving circuit includes a data-signal output section that outputs the m-channel data signals to the plurality of data lines every data line block including m data lines by outputting the m-channel data signals to the m image signal lines; and an adjusting section that adjusts the m-channel data signals so that, when a reference signal whose signal level is a reference level is input, the m-channel data signals at least partly reach signal levels different from the reference level for each channel, the number of continuous channels of signals at the same signal level is smaller than or equal to a predetermined number, and the differences between the signal levels and the reference level fall within a predetermined range.

In this driving circuit, in operation, m-channel data signals are output to m image signal lines by the data-signal output section. That is, a data signal is divided into m channels and output to an electro-optic device. The data signals output to the m image signal lines are supplied to individual data line blocks each having m data lines. Here "m" is a natural number greater than or equal to 2 and takes on a value smaller than the total number of the data lines and, preferably, a value such that a multiple of m is the total number of the data lines. The data-signal output section is provided typically for each channel, that is, m data-signal output sections are provided. Each of the data-signal output sections outputs a data signal to the image signal lines. This allows the electro-optic device to write data signals to a plurality of pixels at the same time, thus ensuring sufficient time to write data voltages to the individual pixels. This allows stable display also by an electro-optic device having a high-resolution panel, for example.

In this case, particularly, the adjusting section adjusts the output m-channel data signals so that, when a reference signal whose signal level is a reference level is input, the m-channel data signals at least partly reach signal levels (voltages) different from the reference level. That is, the m-channel data signals are adjusted so that, when the same reference signal is output to the individual channels, signals at signal levels different from the reference level is output form at least on channel. In adjusting the signal levels, typically, a reference signal whose signal level is a reference level is actually input as an adjusting data signal. The reference signal and the m-channel data signals are compared so that the amounts of adjustment of the signal levels of the individual channels are determined.

By the adjustment described above, data signals at signal levels different from the reference level are output from the data-signal output section for each channel. There may be one or a plurality of reference-level signals in the m channels. Alternatively, all the data signals of the m channels may be at signal levels different from the reference level. Since such an adjustment can be made, for example, only by adding a predetermined adjustment value to the data signals, it can be achieved by a relatively simple circuit configuration as compared with an adjustment for eliminating variations in signal level (that is, an adjustment in which all the signal levels of m-channel signals are adjusted to a predetermined level).

The adjusting section adjusts the data signal so that the number of continuous channels of signals at the same signal level is smaller than or equal to a predetermined number. Here the "predetermined number" is most preferably one, which prevents data signals at the same signal level from being arranged next to each other on the m-channel data signal sequence. The predetermined number may be two or more in accordance with the number of channels or wiring pitch. In any case, the predetermined number takes a value smaller than m and, preferably, smaller than m÷2. Taking a value smaller than m÷2 allows the proportion of part whose signal level is the same to be smaller than half of the entire image.

The study of the inventor shows that even if data signals at different signal levels are output (that is, even if the signal levels of output data signals vary), the difference in signal level hardly causes display irregularities unless data signals at the same signal level are supplied to data line blocks that continue by a predetermined number. In other words, when data signals at the same signal level are supplied to a predetermined number or more continuous data line blocks, display irregularities can occur with high possibility. This possibility increases with an increasing number of continuous data line blocks to which data signals at the same signal level are supplied.

Accordingly, as described above, the possibility of generation of display irregularities in a display image can be prevented by adjusting data signals so that continuous channels of the same signal level reaches a predetermined number or less. That is, data signals at a signal level different from another channel are continuously supplied to adjacent data line blocks, thereby preventing display irregularities from becoming apparent.

Since data signals are output as described above, display irregularities due to the characteristics of an electro-optic device to be driven can also be reduced. That is, the driving circuit according to embodiments of the invention has the effect also on display irregularities that cannot be reduced only by decreasing variations in the signal levels of data signals.

The driving circuit according to embodiments of the invention is configured such that the differences between the adjusted signal levels and the reference level fall within a predetermined range. Here "a predetermined range" is a range that causes no unintended display irregularities in an electro-optic device because of adjustment of signal levels. That is, this is a range that causes no problem due to excessive differences between adjusted signal levels and the reference signal level. The predetermined range is typically set to about 5 mV to 10 mV, depending on the size of a display image. When data signals are adjusted so that the differences between adjusted signal levels and the reference level fall within a predetermined range, occurrence of new display irregularities due to adjustment can be prevented as described above.

As described above, the driving circuit according to embodiments of the invention prevents occurrence of display irregularities by outputting m-channel data signals at different signal levels from one image signal line to another (in other words, by outputting data signals with intended variations in signal level). This allows higher-quality images to be displayed with more simplified circuit configuration.

It is preferable that the adjusting section adjust the m-channel data signals to signal levels different between adjacent channels.

In this case, the adjusting section adjusts m-channel data signals so that adjacent channel signals have different signal levels. This prevents data signals at the same signal level from being arranged next to each other on the m-channel data signal sequence. That is, this prevents data signals at the same signal level from being supplied to continuous data line blocks. This prevents occurrence of display irregularities more effectively.

It is preferable that the adjusting section adjust the m-channel data signals so that the signal level of one of the m-channel data signals reaches a first level and the signal levels of the others of the m-channel data signals reach a second level different from the first level.

In this case, the adjusting section adjusts the signal level of one part of the m-channel data signals to a first level. The signal levels of the other part of the m-channel data signals are adjusted by the adjusting section to a second level different from the first level. The first level and the second level are set to signal levels whose differences from the reference level fall within a predetermined range.

The above adjustment allows the difference between one part and the other part of data signals from the reference level to fall within a predetermined range and their signal levels to differ from each other. This allows the data-signal output section to output data signals at signal levels different from the reference level from one channel to another more preferably.

In the case in which the signal levels are individually adjusted to the first level and the second level, the first level may be the reference level.

With the above configuration, the first level is set as the reference level. Accordingly, the adjustment may be made so that the difference between the first level and the second level falls within a predetermined range. This further simplifies the control for adjusting the signal levels within a predetermined range. This further simplifies the circuit configuration.

It is preferable that the driving circuit further include a detecting section that detects the signal levels of the individual m-channel data signals, and the adjusting section adjust the m-channel data signals individually on the basis of the detected signal levels.

With this configuration, the signal levels of the m-channel data signals output from the data-signal output section are detected by the detecting section. The signal levels of the data signals are adjusted by the adjusting section on the basis of the detected signal levels. This further simplifies the adjustment of signal levels by the adjusting section more preferably. That is, the adjustment of the signal levels of data signals can be made more preferably. This prevents occurrence of display irregularities more effectively.

In this case in which the detecting section is further provided, the driving circuit may further include a calibrating section that calibrates the m-channel data signals on the basis of the detected signal levels so that their signal levels come close to one another, and the adjusting section may be configured to adjust the m-channel data signals after calibration by the calibrating section.

With this configuration, the signal levels are calibrated by the calibrating section before the signal levels are adjusted by the adjusting section. Specifically, the m-channel data signals are individually calibrated on the basis of the signal levels detected by the detecting section so that their signal levels come close to each other. That is, variations in data signals are reduced. The calibrating section typically calibrates the signal levels of data signals so that they come close to a reference level.

The data-signal output section is typically designed in a designing stage to output data signals at the same level. The signal levels of actually output signals may vary among channels because of an impact in a circuit mounting stage, a voltage applied for operation, or the like. Thus, calibration of signal levels can preferably reduce the above-described undesired variations in signal level.

As described above, since signal levels are calibrated prior to adjustment by the adjusting section, the signal levels can be adjusted more easily and appropriately. That is, adjustment of the signal levels of data signals can be mare more preferably. This prevents occurrence of display irregularities more effectively.

An electro-optic device according to a second aspect of the invention includes the driving circuit described above (including its various forms).

Since this electro-optic device includes the driving circuit described above, m-channel data signals are supplied after they are adjusted so that the m-channel data signals at least partly reach signal levels different from the reference level, the number of continuous channels of signals at the same signal level is smaller than or equal to a predetermined number, and the differences from the reference level fall within a predetermined range. This can effectively prevent display irregularities. This allows higher-quality images to be displayed with more simplified circuit configuration.

An electronic apparatus according to a third aspect of the invention includes the electro-optic device described above (including its various forms).

Since this electronic apparatus includes the electro-optic device described above, various electronic apparatuses can be achieved, such as projection display devices, TV receivers, portable phones, electronic notebooks, word processors, viewfinder or monitor-direct-view type videotape recorders, work stations, TV phones, POS terminals, and apparatuses having a touch panel. Another example of this electronic apparatus includes electrophoresis devices such as electronic paper.

According to a fourth aspect of the invention, there is provided a driving method for driving an electro-optic device by outputting data signals that are subjected to serial-to-parallel conversion into m channels through m (m is a natural number greater than or equal to 2) image signal lines to a plurality of data lines. The driving method includes outputting the m-channel data signals to the plurality of data lines every data line block including m data lines by outputting the m-channel data signals to the m image signal lines; and adjusting the m-channel data signals so that, when a reference signal whose signal level is a reference level is input, the m-channel data signals at least partly reach signal levels different from the reference level for each channel, the number of continuous channels of signals at the same signal level is smaller than or equal to a predetermined number, and the differences between the signal levels and the reference level fall within a predetermined range.

Like the above-described driving circuit, this driving method is configured to adjust m-channel data signals during adjusting process so that the m-channel data signals at least partly reach signal levels different from the reference level, the number of continuous channels of signals at the same signal level is smaller than or equal to a predetermined number, and the differences from the reference level fall within a predetermined range. This can effectively prevent display irregularities. This allows higher-quality images to be displayed with more simplified circuit configuration.

This driving method can also adopt various forms as in the driving circuit described above.

BRIEF DESCRIPTION OF THE DRAWINGS

The invention will be described with reference to the accompanying drawings, wherein like numbers reference like elements.

DESCRIPTION OF EXEMPLARY EMBODIMENTS

The operation and other advantages of the invention will become apparent upon a reading of the following description of the preferred embodiments.

Embodiments of the present invention will be described with reference to the drawings.

Electro-Optic Device

An electro-optic device that incorporates a driving circuit according to embodiments of the invention will be described with reference to FIGS. 1 to 5. Here, a thin-film transistor (TFT) active-matrix driven liquid crystal device, which is an example of the electro-optic device of the invention, will be described by way of example.

Figure 1:
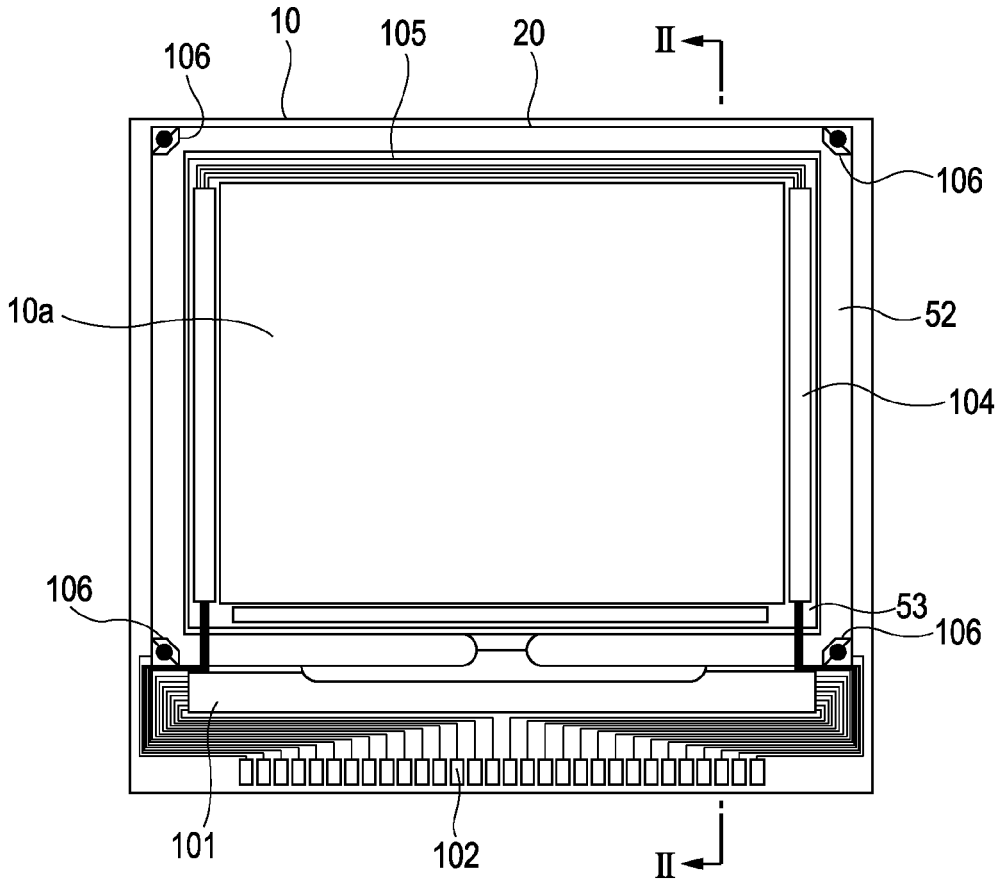
FIG. 1 is a plan view showing the configuration of an electro-optic panel according to an embodiment.
Figure 2:
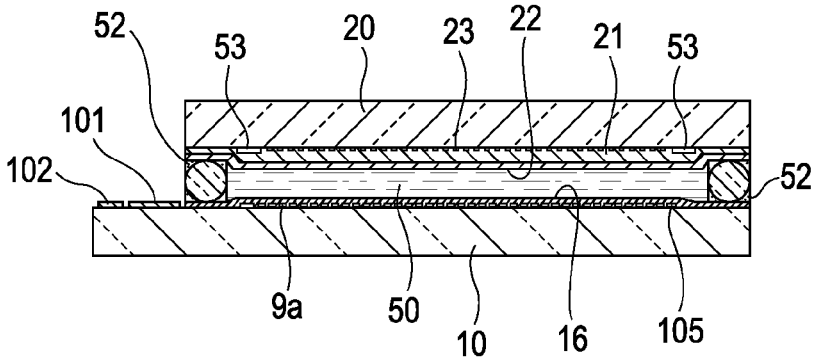
FIG. 2 is a cross-sectional view taken along line II-II in FIG. 1.

Referring first to FIGS. 1 and 2, the configuration of an electro-optic panel of the electro-optic device according to an embodiment will be described. FIG. 1 is a plan view showing the configuration of the electro-optic panel of this embodiment. FIG. 2 is a cross-sectional view taken along line II-II in FIG. 1.

Referring to FIGS. 1 and 2, the electro-optic panel 500 of this embodiment has a TFT-array substrate 10 and a counter substrate 20 on the opposing sides. The TFT-array substrate 10 is a transparent substrate, such as a quarts substrate or a glass substrate, a silicon substrate, or the like. The counter substrate 20 is a transparent substrate, such as a quartz substrate or a glass substrate. Between the TFT-array substrate 10 and the counter substrate 20 is sealed a liquid crystal layer 50. The liquid crystal layer 50 is formed of liquid crystal that is made of one or several kinds of nematic liquid crystal, which is aligned in a predetermined orientation between a pair of alignment films. The TFT-array substrate 10 and the counter substrate 20 are bonded together with a sealing material 52 provided on a sealing area around an image display area 10*a* having a plurality of pixel electrodes.

The sealing material 52 is made of, for example, an ultraviolet cure resin or a thermosetting resin, for bonding the substrates, which is applied on the TFT-array substrate 10 and then hardened by irradiation of ultraviolet rays, heating or the like in its manufacturing process. The sealing material 52 contains scattered gap materials, such as glass fibers or glass beads, for holding a predetermined gap (that is, an inter-substrate gap) between the TFT-array substrate 10 and the counter substrate 20. The gap material may be disposed in the image display area 10*a* or a peripheral area around the image display area 10*a*, in addition to or in place of the gap material mixed in the sealing material 52.

A frame light-shielding film 53 that defines the frame area of the image display area 10*a* is provided in parallel with the inside of the sealing area in which the sealing material 52 is disposed. Part or all of the frame light-shielding film 53 may be provided at the TFT-array substrate 10 as a built-in frame light-shielding film.

Of the peripheral area, an area outside the sealing area in which the sealing material 52 is disposed has a data-line driving circuit 101 and external-circuit connecting terminals 102 along one side of the TFT-array substrate 10. Scanning-line driving circuits 104 are disposed along the two sides next to the one side in such a manner as to be covered with the frame light-shielding film 53. Furthermore, a plurality of wires 105 are provided to connect the two scanning-line driving circuit 104 provided on both sides of the image display area 10*a* in such a manner as to extend along the remaining one side of the TFT-array substrate 10 and to be covered with the frame light-shielding film 53.

The TFT-array substrate 10 has thereon vertically conducting terminals 106 for connecting the substrates 10 and 20 with vertically conductive materials at the positions opposing the four corners of the counter substrate 20. This allows electrical conduction between the TFT-array substrate 10 and the counter substrate 20.

Referring to FIG. 2, the TFT-array substrate 10 has thereon a layered structure in which TFTs for switching pixels, serving as driver elements, and wires, such as scanning lines and data lines, are formed. Although FIG. 2 omits the details of this layered structure, pixel electrodes 9*a* made of a transparent material, such as indium tin oxide (ITO), is formed in a predetermined island pattern on the layered structure.

The pixel electrodes 9*a* are formed in the image display area 10*a* on the TFT-array substrate 10 in such a manner as to face a counter electrode 21. An alignment film 16 is provided on the surface of the TFT-array substrate 10 facing the liquid crystal layer 50, that is, on the pixel electrodes 9*a*, in such a manner as to cover the pixel electrodes 9*a*.

A light-shielding film 23 is formed on the surface of the counter substrate 20 facing the TFT-array substrate 10. The light-shielding film 23 is formed in a grid pattern in plan view on the opposing surface of the counter substrate 20. The light-shielding film 23 specifies a non-open area on the counter substrate 20. The area delimited by the light-shielding film 23 serves as an open area that allows light emitted from, for example, a projector lamp or a direct-view backlight, to pass through. The light-shielding film 23 may be formed in a stripe pattern, and thus the light-shielding film 23 and various components, such as data lines, provided at the TFT-array substrate 10 may specify a non-open area.

The light-shielding film 23 has thereon the counter electrode 21 made of a transparent material, such as ITO, in such a manner as to oppose the pixel electrodes 9*a*. The light-shielding film 23 may also have a color filter (not shown in FIG. 2) for color display in an area including the open area and part of the non-open area of the image display area 10*a*. An alignment film 22 is formed on the counter electrode 21 on the opposing surface of the counter substrate 20.

The TFT-array substrate 10 shown in FIGS. 1 and 2 may have thereon a sampling circuit for sampling image signals on image signal lines and supplies them to the data lines, a precharge circuit for supplying precharge signals at a predetermined voltage level to the data lines prior to the image signals, an inspection circuit for checking the quality of the electro-optic device for defects during manufacture and at shipment and so on, in addition to the driving circuits such as the data-line driving circuit 101 and the scanning-line driving circuits 104.

Figure 3:
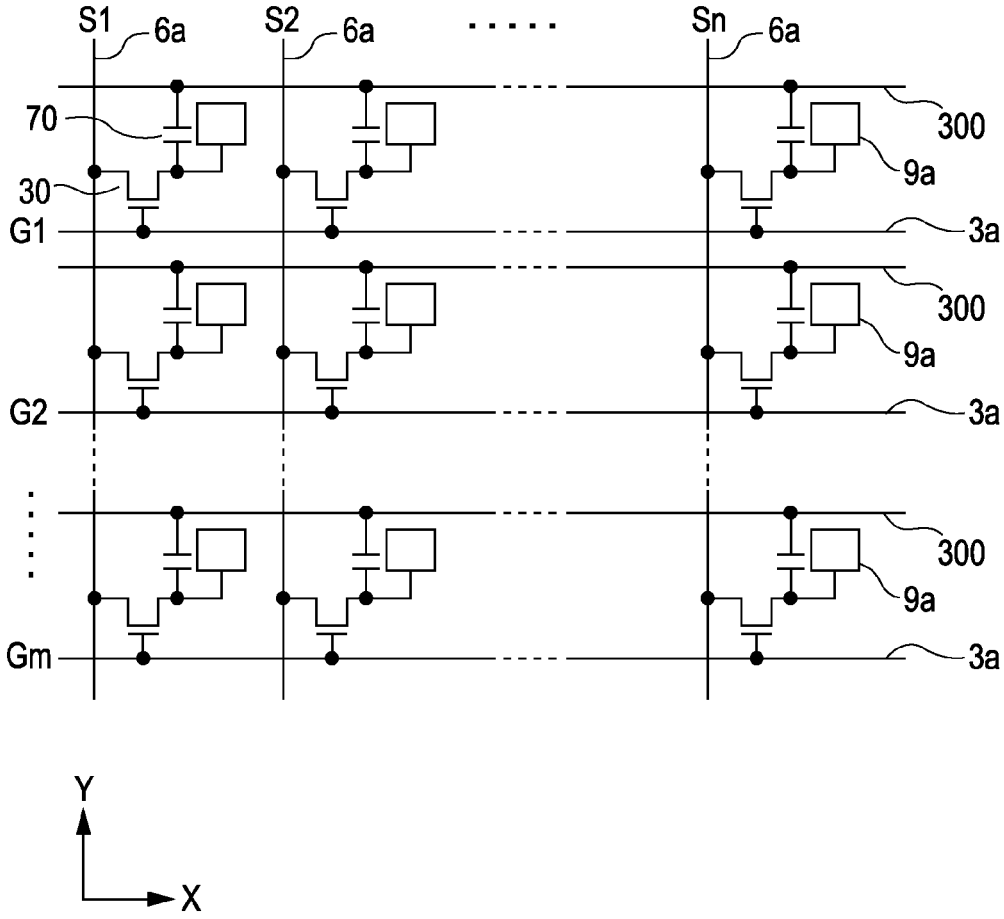
FIG. 3 is a diagram of an equivalent circuit including various elements and wires that constitute the image display area of the electro-optic device according to the embodiment.
Figure 4:
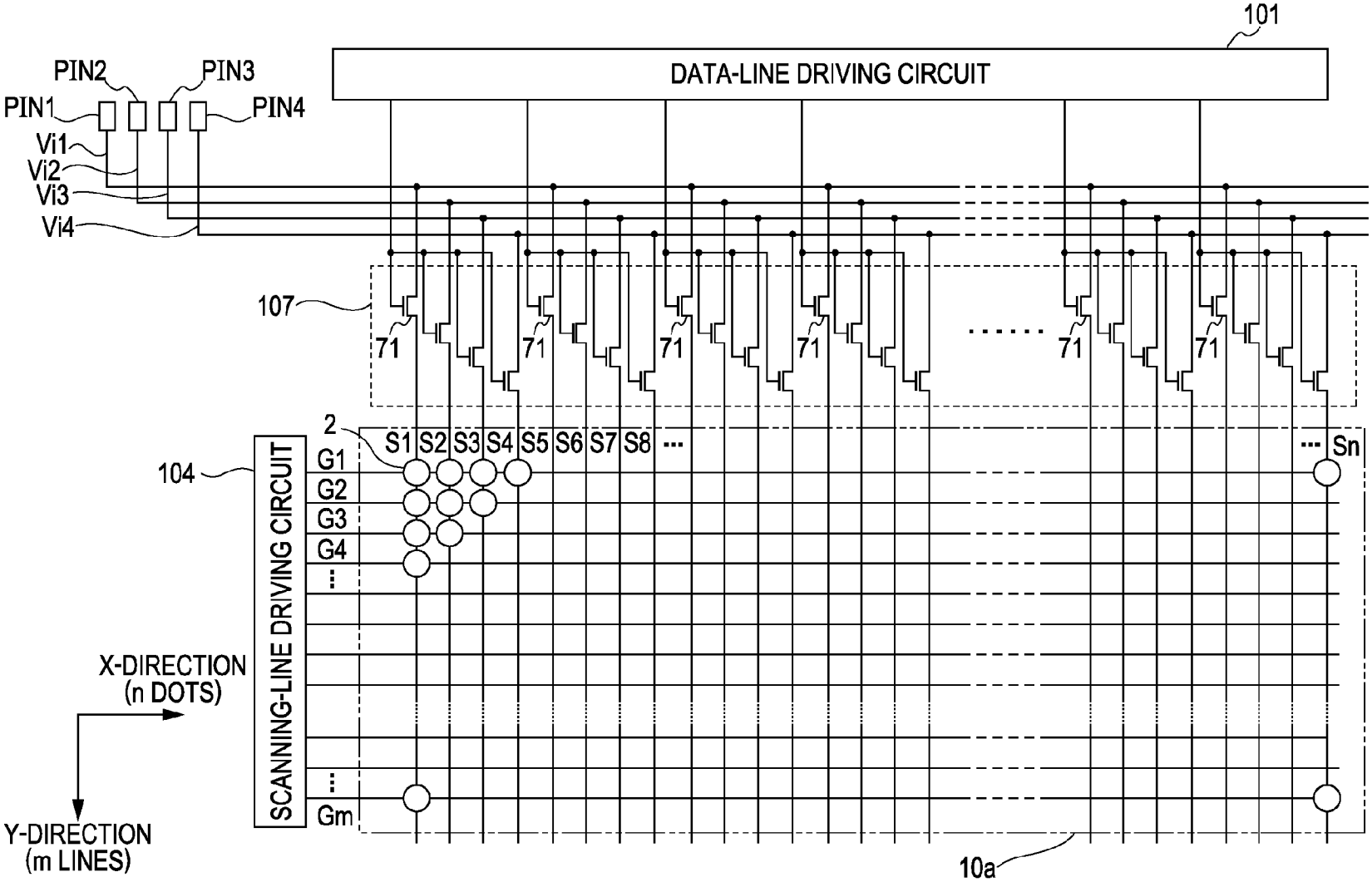
FIG. 4 is a plan view showing the configuration of a phase-expansion driving circuit of the electro-optic device according to the embodiment.

Referring next to FIG. 3, the electrical configuration of the pixel section of the electro-optic device of this embodiment will be described. FIG. 3 is a diagram of an equivalent circuit including various elements and wires of a plurality of matrix-form pixels that constitute the image display area of the electro-optic device of this embodiment. FIG. 4 is a plan view showing the configuration of a phase-expansion driving circuit of the electro-optic device of this embodiment.

Referring to FIG. 3, the matrix-form pixels that constitute the image display area 10*a* each have the pixel electrode 9*a* and a TFT 30. The TFT 30 is electrically connected to the pixel electrode 9*a* and controls switching of the pixel electrode 9*a* during the operation of the electro-optic device of this embodiment. Data lines 6*a*, which are supplied with image signals, are electrically connected to the sources of the TFTs 30. Image signals S1, S2 to Sn written to the data lines 6*a* are divided into m channels (m is a natural number greater than or equal to 2) and are supplied to the individual data line blocks each composed of m data lines 6*a*. That is, the electro-optic device of this embodiment performs so-called phase expansion driving.

Referring to FIG. 4, in the case where image signals are divided into four channels (that is, four-phase expansion), for example, the four channels of image signals are output from PINs 1 to 4 of an integrated circuit included in the driving circuit, respectively. The four channels of image signals output from the PINs 1 to 4 are sent to a sampling circuit 107 through image signal lines Vi1 to Vi4. The sampling circuit 107 turns on and off sampling switches 71 at predetermined timing so that the image signals are supplied individual data line blocks each composed of four data lines (for example, data lines S1, S2, S3, and S4).

This allows the electro-optic device to write image signals to a plurality of pixels at the same time, thus ensuring sufficient time to write image signals to the pixels. This permits an electro-optic device having a high-resolution panel to perform stable display.

Referring back to FIG. 3, the gates of the TFTs 30 are electrically connected to scanning lines 3*a*. The electro-optic device of this embodiment is configured to apply pulsed scanning signals G1, G2 to Gm to the scanning lines 3*a* in that order in line sequence at predetermined timing. The pixel electrodes 9*a* are electrically connected to the corresponding drains of the TFTs 30. The pixel electrodes 9*a* are written the image signals S1, S2 to Sn supplied from the data lines 6*a* at predetermined timing by closing the switch of the TFTs 30 serving as switching devices for a fixed period of time. The image signals S1, S2 to Sn at a predetermined level, which are written to the liquid crystal, one example of an electro-optic material, through the pixel electrodes 9*a*, are held for a fixed period of time between the pixel electrodes 9*a* and the counter electrode 21 formed on the counter substrate 20.

The liquid crystal that constitutes the liquid crystal layer 50 (see FIG. 2) changes in the orientation and order of molecular association in accordance with the level of applied voltage to thereby modulate light, allowing gray-scale images to be displayed. In a normally white mode, the transmittance of incident light decreases in accordance with the voltage applied to each pixel. In a normally black mode, the transmittance of incident light increases in accordance with the voltage applied to each pixel, thus allowing light with a contrast according to image signals to be emitted from the electro-optic device in total.

To prevent leakage of the held image signals, a storage capacitor 70 is added in parallel to a liquid crystal capacitor formed between the pixel electrode 9*a* and the counter electrode 21 (see FIG. 2). The storage capacitor 70 is a capacitor element that functions as a hold capacitor that temporarily holds the potential of each pixel electrode 9*a* when an image signal is supplied. One electrode of the storage capacitor 70 is connected to the drain of the TFT 30 in parallel to the pixel electrode 9*a*, and the other electrode is connected to a capacitor line 300 having a fixed potential so as to provide a constant potential. The storage capacitor 70 can improve the potential holding characteristic of the pixel electrode 9*a*, thus improving display characteristics such as improving contrast and reducing flickering.

Figure 5:
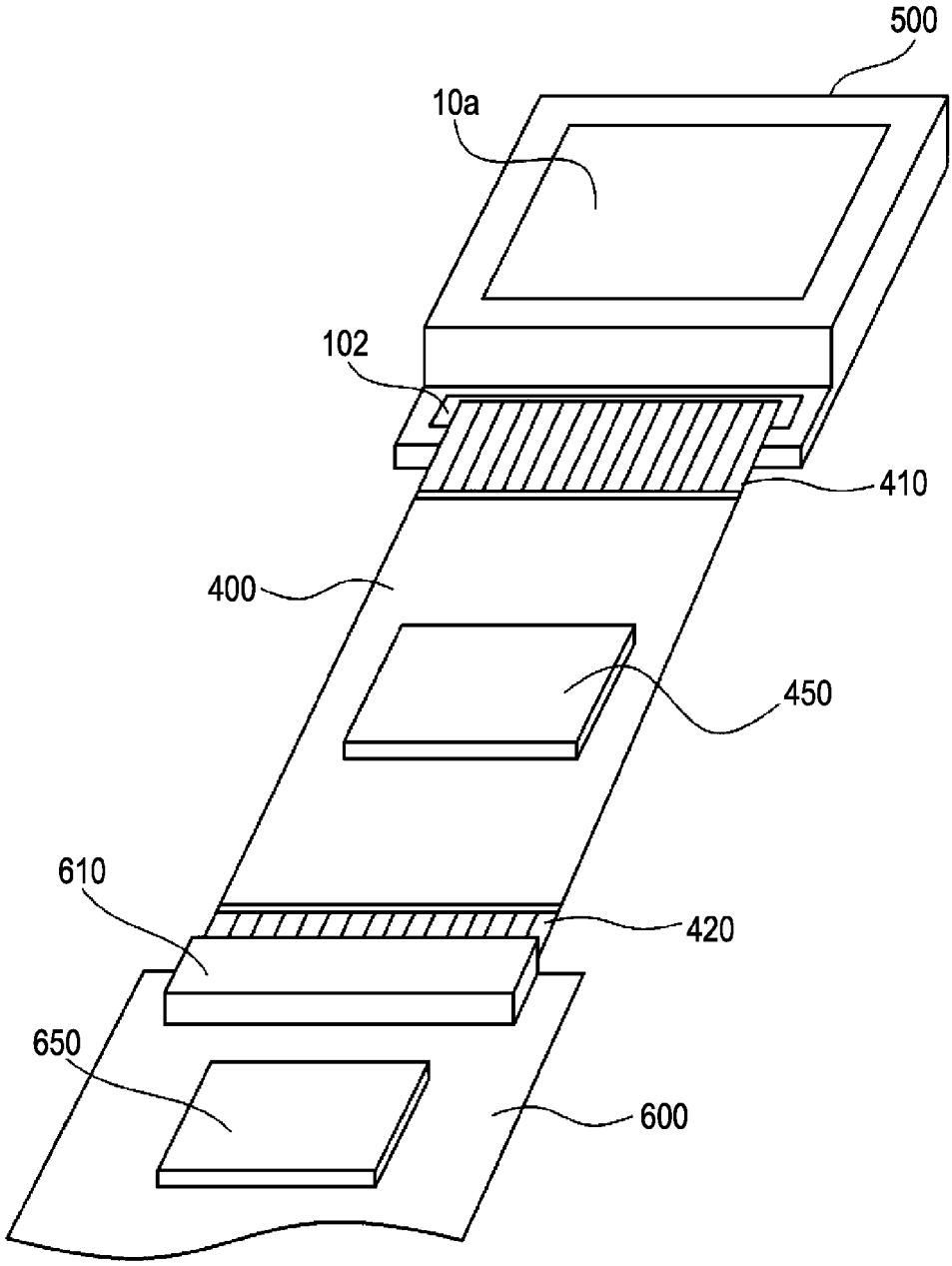
FIG. 5 is a perspective view showing the overall configuration of the electro-optic device according to the embodiment.

Next, the overall configuration of the electro-optic device of this embodiment will be described with reference to FIG. 5. FIG. 5 is a perspective view showing the overall configuration of the electro-optic device of this embodiment. FIG. 5 omits the details of the components of the electro-optic panel 500 shown in FIGS. 1 and 2 as appropriate for the convenience of explanation.

Referring to FIG. 5, the electro-optic device of this embodiment includes the above-described electro-optic panel 500, a flexible board 400, and a circuit board 600.

The flexible board 400 includes connecting terminals 410 and 420 at both ends. The connecting terminal 410 is electrically connected to the external-circuit connecting terminals 102 of the electro-optic panel 500. The connecting terminal 420 is electrically connected to a connector 610 on the circuit board 600. That is, the electro-optic panel 500 and the circuit board 600 are electrically connected to each other with the flexible board 400 therebetween.

On the flexible board 400, a first integrated circuit 450 is provided. The driving circuit according to embodiments, to be described later, includes part or all of the first integrated circuit 450, a driving circuit mounted in the electro-optic panel 500, a second integrated circuit 650 provided on the circuit board 600, or other integrated circuits (not shown).

The configuration and operation of the driving circuits of the embodiments and advantages thereof will be described in detail herein.

Driving Circuit and Driving Method

Driving circuits and driving methods of the embodiments will be described with reference to FIGS. 6 to 15.

First Embodiment

Figure 6:
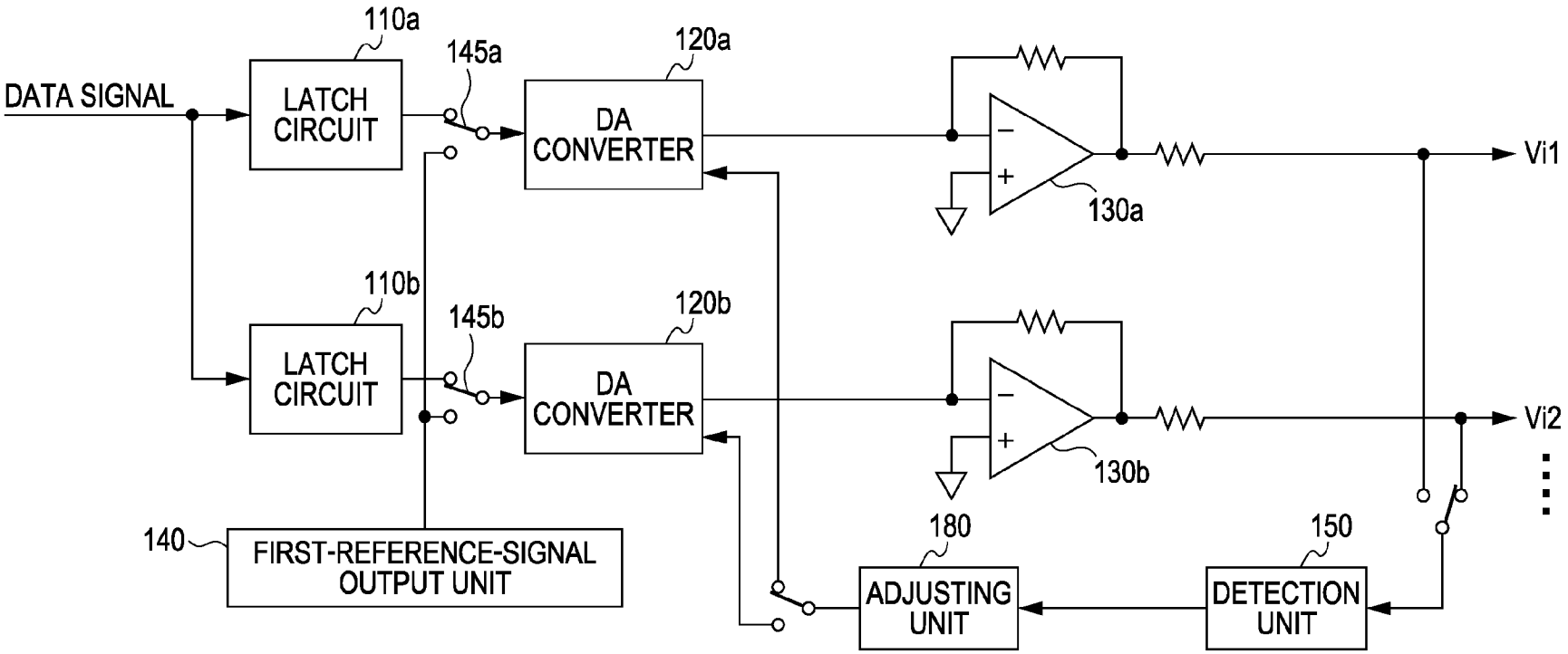
FIG. 6 is a block diagram showing the circuit configuration of a driving circuit according to a first embodiment.

Referring to FIG. 6, the circuit configuration of a driving circuit according to a first embodiment will be first described. FIG. 6 is a block diagram showing the circuit configuration of the driving circuit according to the first embodiment. FIG. 6 shows only output circuits corresponding to two image signal lines Vi1 and Vi2 of the image signal lines Vi1 to Vi4 shown in FIG. 4 for the convenience of description and omits output circuits and the like corresponding to the other image signal lines. This applies also to the FIG. 12.

Referring to FIG. 6, the driving circuit according to the first embodiment includes a plurality of latch circuits 110, a plurality of digital-to-analog (DA) converters 120, a plurality of output circuits 130, a first-reference-signal output unit 140, a switching section 145, a detection unit 150, and an adjusting unit 180.

The latch circuits 110 are electronic circuits that temporarily store input data signals and then output them in sequence, which are provided in a one-to-one correspondence with divided data signals.

The DA converters 120 are electronic circuits that converts input data signals from digital to analog and output them, which are provided in a one-to-one correspondence with divided data signals.

The output circuits 130 are one example of "data-signal output section" of the invention, which amplify output data signals and output them. Like the latch circuits 110 and the DA converters 120 described above, the output circuits 130 are provided in a one-to-one correspondence with divided data signals.

The first-reference-signal output unit 140 and the switching section 145 are configured such that a first reference signal output from the first-reference-signal output unit 140 is input to each of the DA converters 120 in place of data signals output from the latch circuits 110 when the switching section 145 switches.

The detection unit 150 is an example of "a detecting section" of the invention and detects the signal levels of data signals output from output circuits 130*a* and 130*b*.

The adjusting unit 180 is an example of "an adjusting section" of the invention and adjusts the output of the DA converter 120 on the basis of a difference calculated by a calculating unit 160.

Figure 7:
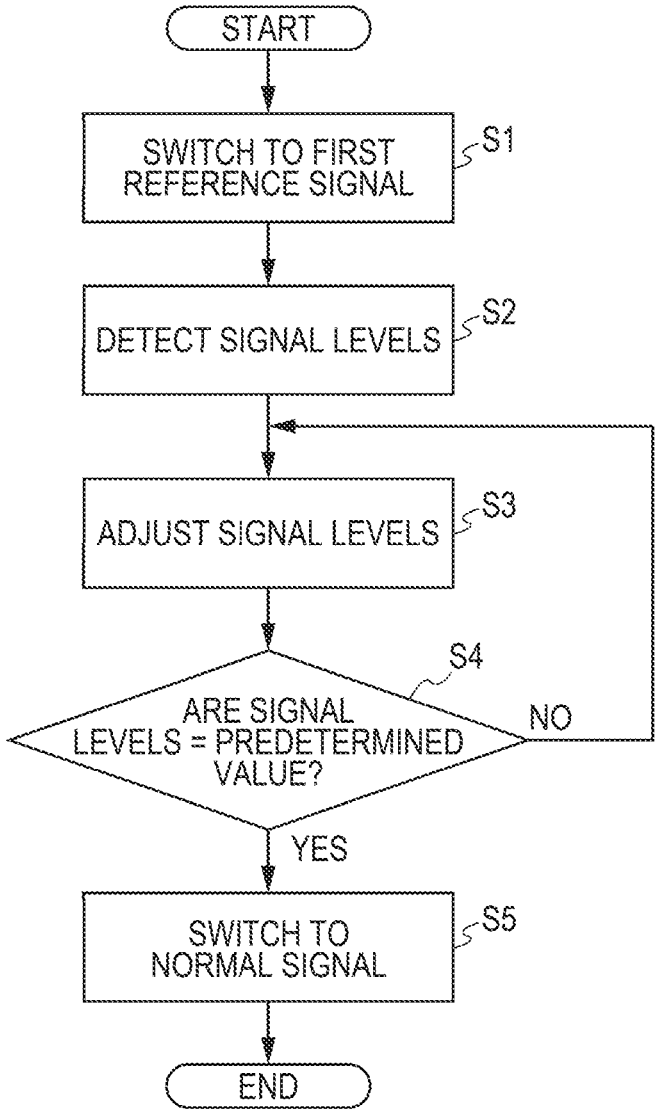
FIG. 7 is a flowchart showing a series of process steps of a driving method according to the first embodiment.
Figure 8:
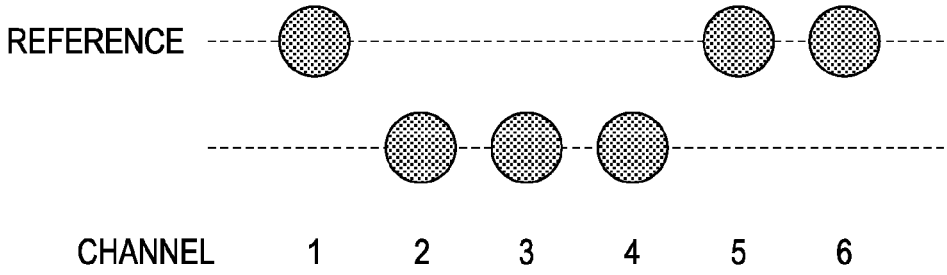
FIG. 8 is a conceptual diagram showing the signal levels of data signals of individual channels output by a driving method according to a comparative example.
Figure 9:
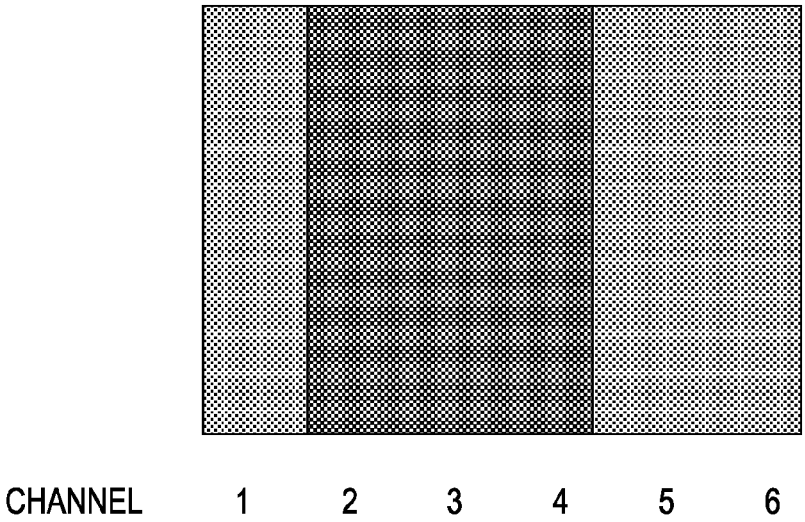
FIG. 9 is a conceptual plan view showing display irregularities generated in an image display area of an electro-optic device driven by the driving method according to the comparative example.
Figure 10:
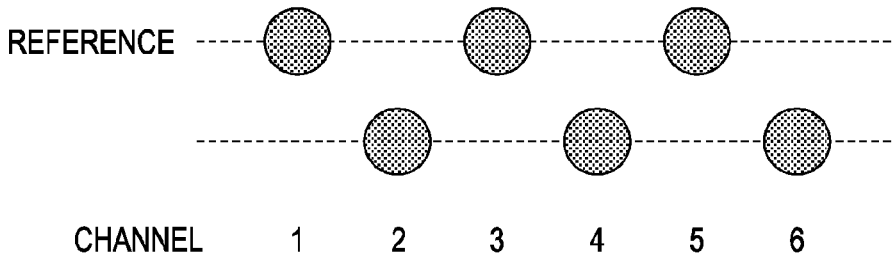
FIG. 10 is a conceptual diagram (part 1) showing the signal levels of data signals of individual channels output by the driving method according to the first embodiment.
Figure 11:
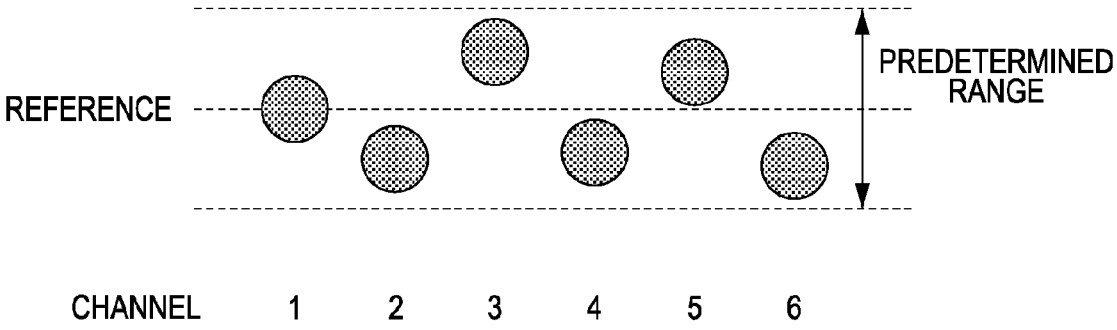
FIG. 11 is a conceptual diagram (part 2) showing the signal levels of data signals of individual channels output by the driving method according to the first embodiment.

Then, a driving method according to the first embodiment will be described with reference to FIGS. 7 to 11 in addition to FIG. 6. FIG. 7 is a flowchart showing a series of process steps of the driving method according to the first embodiment. FIG. 8 is a conceptual diagram showing the signal levels of data signals of individual channels output by a driving method according to a comparative example. FIG. 9 is a conceptual plan view showing display irregularities generated in an image display area of an electro-optic device driven by the driving method according to the comparative example. FIGS. 10 and 11 are conceptual diagrams showing the signal levels of data signals of individual channels output by the driving method according to the first embodiment. Here, the driving method according to the first embodiment will be described together with the operation of the driving circuit according to the first embodiment. Since FIGS. 8 to 11 show data signals when six-phase expansion driving is performed by way of example for the convenience of description, they do not correspond accurately to the configuration of the driving circuit in FIGS. 4 and 6. The examples shown in FIGS. 8 to 11 can be thought to correspond to a case in which six output circuits 130 shown in FIG. 6 are provided.

Referring to FIGS. 6 and 7, when a process by the driving circuit according to the first embodiment is started, first, the first-reference-signal output unit 140 outputs a first reference signal, and the switching sections 145*a* and 145*b* are switched so that the first reference signal is input to each of the DA converters 120*a* and 120*b* (step S1). That is, in place of data signals for image display which are input through the latch circuits 110*a* and 110*b*, the first reference signal is input to each of the DA converters 120*a* and 120*b*. Thus, the output circuits 130*a* and the 130*b* each output the first reference signal.

When the data signals are switched to the first reference signals, the detection unit 150 detects the signal levels of the first reference signals output from the output circuits 130*a* and the 130*b* (step S2). The detected signal levels are output to the adjusting unit 180.

The adjusting unit 180 adjusts the m-channel data signals individually so that the m-channel data signals at least partly reach signal levels different from a reference level for each data line block, the number of signals of continuous channels at the same signal level is smaller than or equal to a predetermined number, and the differences between the signal levels and the reference level fall within a predetermined range (step S3).

As shown in FIG. 8, supposing that the signal levels of signals of continuous channels, channel 2, channel 3, and channel 4, are different from the signal levels of channel 1, channel 5, and channel 6 at the reference level, a difference in brightness or color tone occurs in the locations of the image display area 10*a* (see FIG. 1) of the electro-optic device corresponding to channel 2, channel 3, and channel 4. Since such a difference in brightness or color tone corresponds to the continuous channels, it can easily be visually recognized, which appears as linear display irregularities in the entire image display area 10*a*. That is, the quality of display images is deteriorated.

However, since the driving method according to this embodiment adjusts signal levels so that a predetermined number or more of channels at the same signal level are not arranged continuously, the above-described display irregularities do not occur, or hardly or cannot be visually recognized, even if they occur, thereby preventing a deterioration in the quality of display images.

Since the signal levels are adjusted as described above, for example, display irregularities due to the characteristic of an electro-optic device to be driven can be reduced. That is, the driving method according to this embodiment has an effect also on display irregularities that cannot be reduced only by decreasing variations in signal level of data signals.

As shown in FIG. 10, the data signals of the individual channels are adjusted to alternately different signal levels, for example. As shown in FIG. 11, the data signals may be adjusted to different signal levels, provided that differences from the reference level falls within a predetermined range.

Referring back to FIG. 7, after the signal levels have been adjusted, it is determined whether the signal levels have reached a predetermined value (that is, a target value for adjustment) (step S4). This determination is made by the detection unit 150 detecting the signal levels again. If the signal levels have not reached the predetermined value (step S4: NO), the signal levels are adjusted again in step S3. Thus, even if the signal levels cannot be adjusted appropriately by one adjustment because of, for example, an insufficient adjusting period, the signal levels can be adjusted to the predetermined value by repeating adjustment. If the signal levels have reached the predetermined value (step S4: YES), the switching section 145 is switched so that the data signals output from the output circuit 130 are switched from the first reference signals to normal data signals (step S5). That is, a normal operation for displaying an image is started and the process ends.

A series of the above-described processes are started, for example, when the power source of the electro-optic device is turned on or by a user operation. Typically, once the signal levels are adjusted, the effect of the adjustment continues until the device is started again.

As described above, the driving circuit and the driving method according to the first embodiment can effectively prevent display irregularities by the adjusting unit 180 adjusting the signal levels of data signals, thereby allowing high-quality images to be displayed.

Second Embodiment

A driving circuit and a driving method according to a second embodiment will be described with reference to FIGS. 12 to 15. The second embodiment differs from the first embodiment in that it calibrates the signal levels of data signals and is substantially the same in the others. Accordingly, in the second embodiment, calibration of signal levels will be described in detail, and descriptions of the other configurations will be omitted as appropriate.

Figure 12:
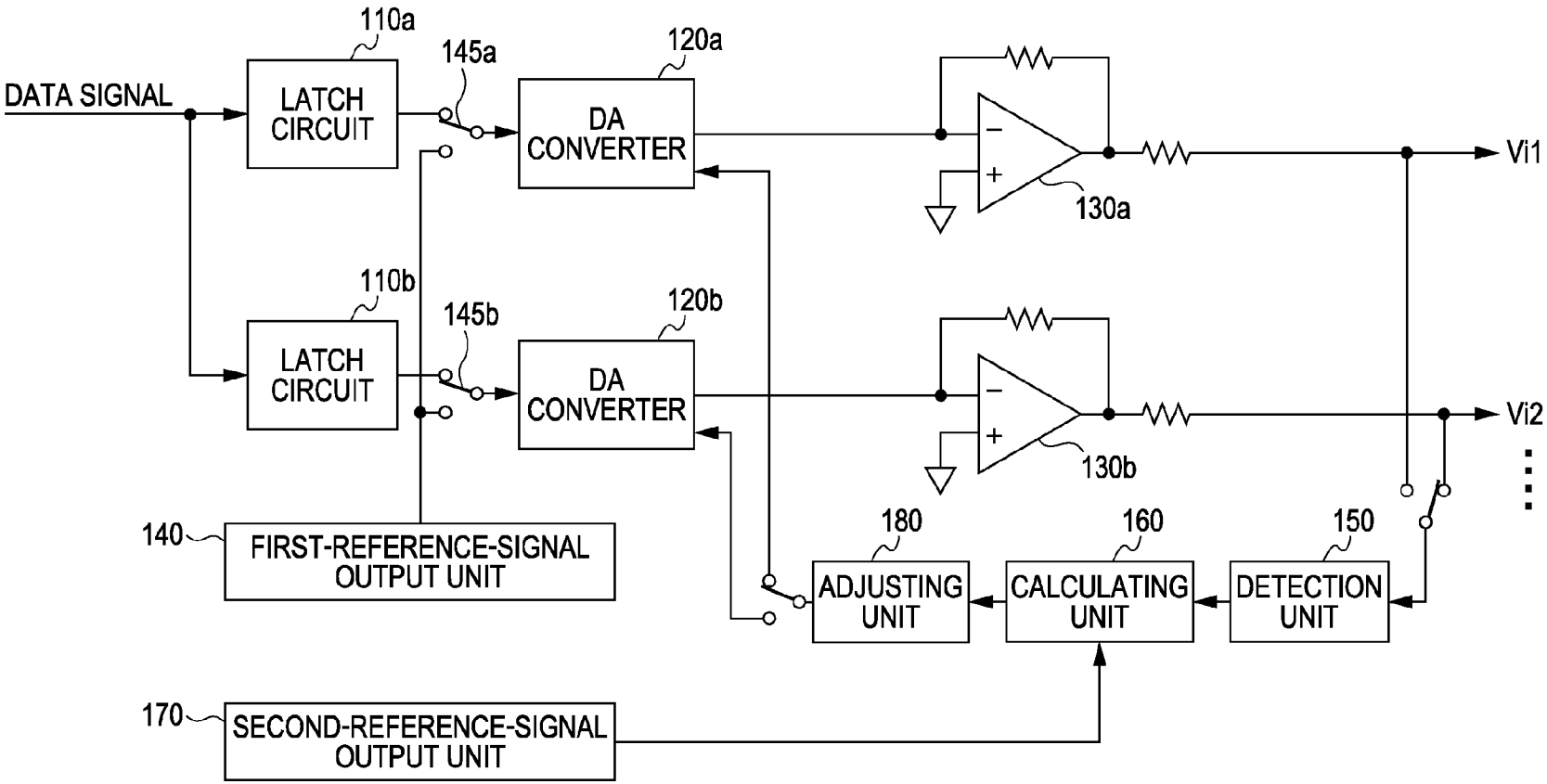
FIG. 12 is a block diagram showing the circuit configuration of a driving circuit according to a second embodiment.

First, the circuit configuration of the driving circuit according to the second embodiment will be described with reference to FIG. 12. FIG. 12 is a block diagram showing the circuit configuration of the driving circuit according to the second embodiment. In the following drawings, the same components as those of the first embodiment shown in FIGS. 6 to 11 are given the same reference numerals.

Referring to FIG. 12, the driving circuit according to the second embodiment includes a calculating unit 160 and a second-reference-signal output unit 170, in addition to the configuration of the driving circuit according to the first embodiment.

The calculating unit 160 is an example of "a calculating section" of the invention, which is a calculating circuit that calculates the difference between the signal level of a second reference signal output from a second-reference-signal output unit 170, which is an example of "a second-reference-signal output section" of the invention, and a signal level detected by the detection unit 150.

The adjusting unit 180 is configured to have a function as an example of "a calibrating section" of the invention, in addition to a function as an example of the "adjusting section" of the invention. That is, the adjusting unit 180 has the function of calibrating the signal levels of individual channels to the same signal level, in addition to the function of adjusting the signal levels to different signal levels from one channel to another as described in the first embodiment.

Figure 13:
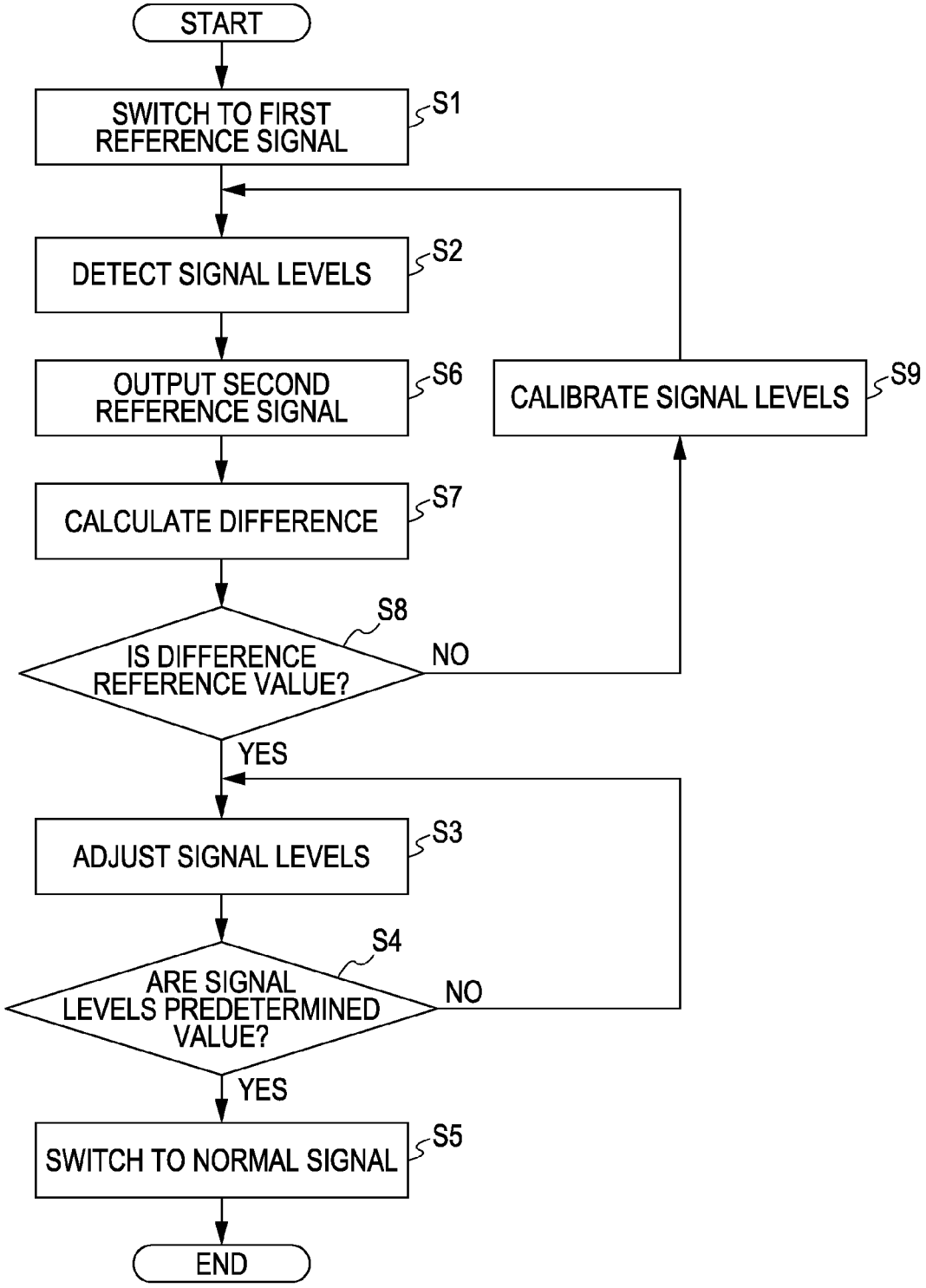
FIG. 13 is a flowchart showing a series of processes of a driving method according to the second embodiment.
Figure 14:
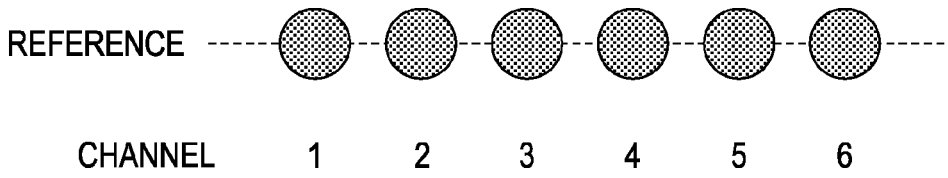
FIG. 14 is a conceptual diagram showing the signal levels of data signals of individual channels after calibration by the driving method according to the second embodiment.
Figure 15:
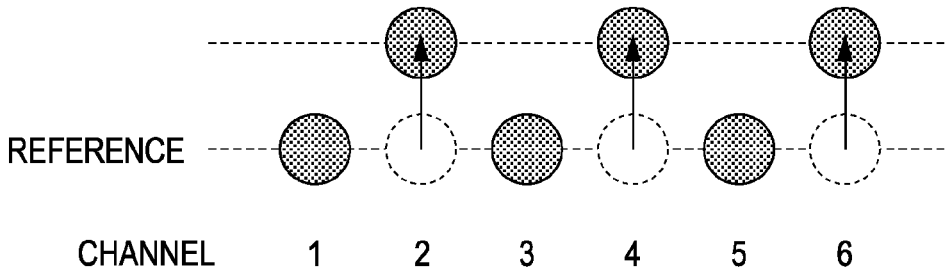
FIG. 15 is a conceptual diagram showing the signal levels of data signals of individual channels after calibration by the driving method according to the second embodiment.

Next, the driving method according to the second embodiment will be described with reference to FIGS. 13 to 15, in addition to FIG. 12. FIG. 13 is a flowchart showing a series of the processes of the driving method according to the second embodiment. FIG. 14 is a conceptual diagram showing the signal levels of data signals of individual channels after calibration by the driving method according to the second embodiment. FIG. 15 is a conceptual diagram showing the signal levels of data signals of individual channels after calibration by the driving method according to the second embodiment. Here, the driving method according to the second embodiment will be described together with the operation of the driving circuit according to the second embodiment described above.

Referring to FIGS. 12 and 13, when the process by the driving circuit according to the second embodiment is started, first, the processes of steps S1 and S2 are executed, as in the first embodiment described above. That is, the switching sections 145*a* and 145*b* are switched so that the first reference signals are output from the output circuits 130*a* and the 130*b*, and the signal levels of the first reference signals are detected by the detection unit 150.

When the signal levels are detected, the second-reference-signal output unit 170 outputs a second reference signal at a signal level corresponding to the signal level of the first reference signal to the calculating unit 160 (step S6). The calculating unit 160 calculates the difference between the signal levels detected by the detection unit 150 and the signal level of the second reference signal (step S7). That is, here, the difference between the signal level of the first reference signal output from the output circuit 130*a* and the signal level of the second reference signal and the difference between the signal level of the first reference signal output from the output circuit 130*b* and the signal level of the second reference signal are calculated. The calculated differences are output to the adjusting unit 180.

When the differences are input, the adjusting unit 180 determines whether the differences are equal to a reference value (step S8). That is, the adjusting unit 180 determines whether the differences have reached a predetermined reference value for adjusting the signal levels. If all the calculated differences have reached the reference value (step S8: YES), then the process moves forward to the processes of step S3 and later. If any of the calculated differences is not the reference value (step S8: NO), then the adjusting unit 180 calibrates the outputs of the DA converters 120*a* and 120*b* so that the calculated differences come close to the reference value (step S8). That is, the adjusting unit 180 adjusts the outputs so that the signal levels of the signals output from the output circuits 130*a* and the 130*b* come close to each other. Thus, variations in the signal levels of the output circuits 130*a* and the 130*b* are reduced.

Referring to FIG. 14, supposing that six-phase expansion driving is performed, as in the first embodiment, the signal levels are brought to the same value by the above-described calibration, as shown in the drawing. Although FIG. 14 shows a case in which the signal levels are calibrated to the reference level, they may be calibrated to a value different from the reference level.

Referring back to FIG. 13, after the signal levels have been calibrated, the processes of step S3 and S4 are executed so that the signal levels are adjusted, as described in the first embodiment. That is, the adjusting unit 180 adjusts the m-channel data signals individually so that the m-channel data signals at least partly reach signal levels different from a reference level for each data line block, the number of signals of continuous channels at the same signal level is smaller than or equal to a predetermined number, and the difference between the signal levels and the reference level falls within a predetermined range.

As described above, the signal levels of the data signals of individual channels are once calibrated to the same signal level, and are then adjusted to different signal levels. Executing calibration before adjustment can further simplify the process of adjustment.

Referring to FIG. 15, executing calibration allows the signal levels of continuous channels of signals to be made different by adjusting the signal levels of only odd-numbered channels of signals to a higher value by a predetermined value. The accuracy of the calibration may not be high, considering that the signal levels change also after calibration. That is, the accuracy is enough only to bring the data signals of individual channels to substantially the same signal levels, not making them to the same signal levels.

Referring back to FIG. 13 again, after the signal levels have been adjusted, the switching section 145 is switched, so that the data signals output from the output circuits 130 are switched from the first reference signals to normal data signals (step S5). That is, a normal operation for displaying an image is started, and the process ends.

As described above, the driving circuit and the driving method according to the second embodiment allow the process of adjustment to be performed more easily and reliably, thus effectively preventing display irregularities. Accordingly, high-quality images can be displayed.

Electronic Apparatus

Figure 16:
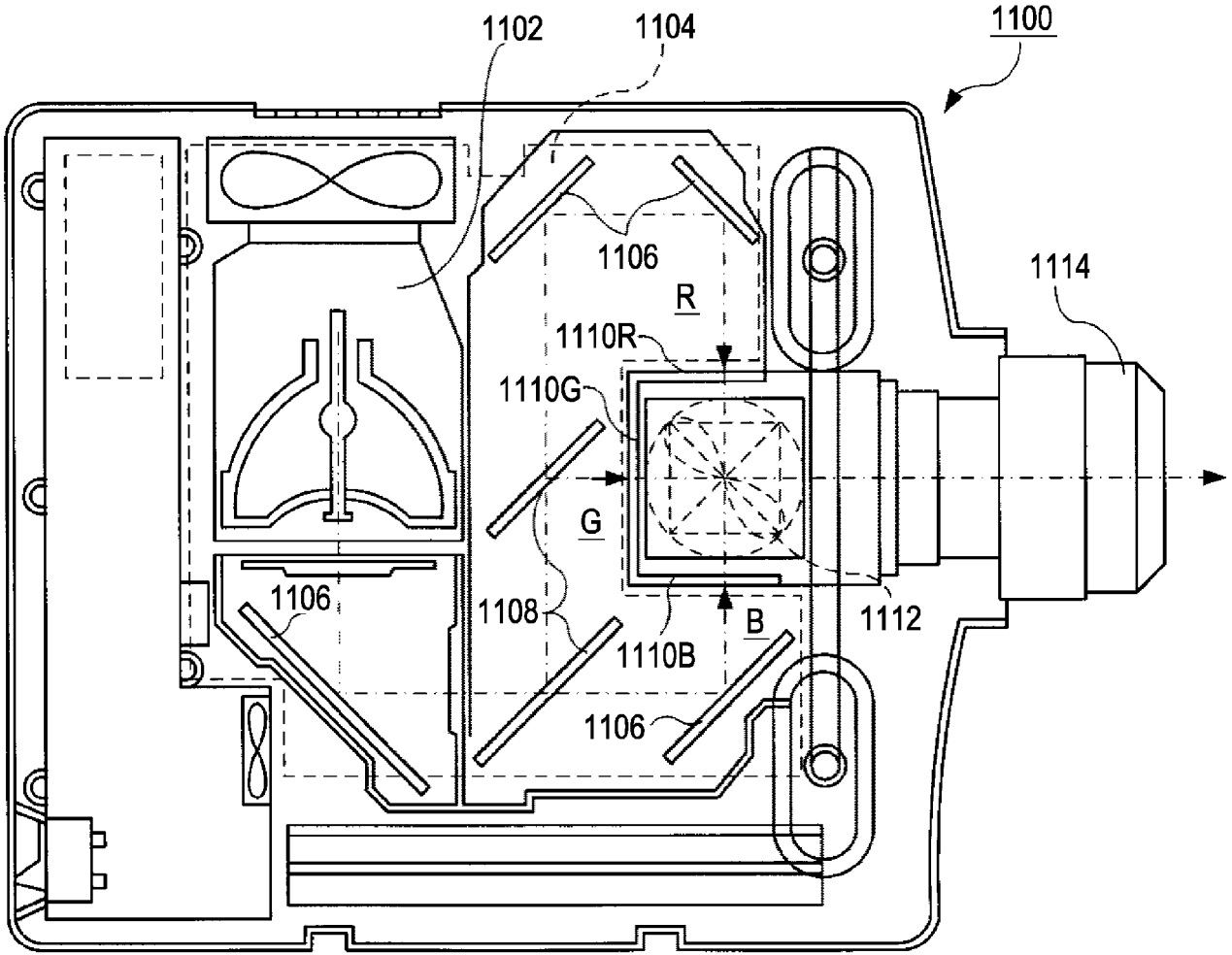
FIG. 16 is a plan view of a configuration example of a projector, which is an example of an electronic apparatus incorporating the electro-optic device.

Next, applications of the above-described liquid crystal device, which is an electro-optic device, to various electronic apparatuses will be described. FIG. 16 is a plan view of a configuration example of a projector. Here, a projector that uses the liquid crystal device as a light valve will be described.

As shown in FIG. 16, the projector 1100 accommodates a lamp unit 1102 including a white light source such as a halogen lamp. Projection light emitted from the lamp unit 1102 is separated into the three primary colors of RGB by four mirrors 1106 and two dichroic mirrors 1108 disposed in a light guide 1104 and enters liquid crystal panels 1110R, 1110G, and 1110B serving as light valves corresponding to the primary colors.

The liquid crystal panels 1110R, 1110G, and 1110B have the same structure as the above-described liquid crystal device, which are driven by the RGB primary-color signals supplied from an image-signal processing circuit, respectively. The light modulated by the liquid crystal panels 1110R, 1110G, and 1110B enter a dichroic prism 1112 from three directions. The dichroic prism 1112 refracts the R and B lights at 90° and allows the G light to go straight. Accordingly, the images of the individual colors are combined, and thus a color image is projected onto a screen or the like through a projection lens 1114.

Here images displayed on the liquid crystal panels 1110R, 1110G, and 1110B will be discussed. It is necessary to laterally invert an image displayed on the liquid crystal panel 1110G from images displayed on the liquid crystal panels 1110R and 1110B.

There is no need to provide color filters on the liquid crystal panels 1110R, 1110G, and 1110B because lights corresponding to the RGB primary colors are incident thereon by the dichroic mirrors 1108.

In addition to the electronic apparatus described with reference to FIG. 16, various electronic apparatuses can be provided, such as portable personal computers, portable phones, liquid-crystal televisions, viewfinder or monitor-direct-view type videotape recorders, car navigation systems, pagers, electronic notebooks, calculators, word processors, workstations, TV phones, POS terminals, and apparatuses having a touch panel. It is needless to say that the invention can be applied to these electronic apparatuses.

In addition to the liquid crystal devices described in the above embodiments, the invention can also be applied to reflective liquid crystal devices (LCOS), plasma displays (PDPs), field-emission displays (FEDs), surface-conduction electron-emitter displays (SEDs), organic EL displays, digital micromirror devices (DMDs), and electrophoresis devices.

It is to be understood that the invention is not limited to the above-described embodiments and that various changes and modifications may be made without departing from the sprit and scope as set out in the accompanying claims and the specification; driving circuits and driving methods that undergo such changes and modifications, electro-optic devices including such diving circuits, and electronic apparatuses having such electro-optic devices are also within the technical scope of the invention.

The entire disclosure of Japanese Patent Application No. 2008-062221, filed Mar. 12, 2008 is expressly incorporated by reference herein.

What is claimed is:

1. A driving circuit that outputs m channel (m is a natural number greater than or equal to 2) data signals by a serial-to-parallel conversion of serial data signals, the driving circuit comprising:

an m channel data signals output section that generates a first voltage level and a second voltage level different from the first voltage level that represent a first gray scale level, respectively; and an adjusting section that adjusts the first voltage level so that a first difference between the first voltage level and a reference level is a first predetermined level, and adjusts the second voltage level so that a second difference between the second voltage level and the reference level is a second predetermined level different from the first predetermined level, wherein the first voltage level is transmitted through a first image signal line and a second image signal line of a plurality of image signal lines during a first period, the second voltage level is transmitted through a third image signal line of the plurality of image signal lines during the first period, and the second image signal line is adjacent to the first image signal line and the third image signal line.

2. The driving circuit according to claim 1, wherein the first predetermined level and the second predetermined level are within 5 mV to 10 mV.

3. The driving circuit according to claim 1, wherein the first voltage level is transmitted through the second image signal line of the plurality of image signal lines during a second period, and the second voltage level is transmitted through the first image signal line of the plurality of image signal lines during the second period.

4. The driving circuit according to claim 1, further comprising:

a detecting section that detects a first detecting level of the first voltage level and a second detecting level of the second voltage level, and wherein the adjusting section adjusts the first voltage level and the second voltage level on a basis of the first detecting level and the second detecting level, respectively.

5. The driving circuit according to claim 4, further comprising:

a calibrating section that calibrates the first voltage level and the second voltage level on a basis of the first detecting level and the second detecting level so that the first voltage level and the second voltage level come close to one another, and wherein the adjusting section adjusts the first voltage level and the second voltage level after the calibration by the calibrating section.

6. An electro-optic device comprising the driving circuit according to claim 1.

7. An electronic apparatus comprising the electro-optic device according to claim 6.

8. A driving circuit that outputs m channel (m is a natural number greater than or equal to 2) data signals by a serial-to-parallel conversion of serial data signals, the driving circuit comprising:

an m channel data signals output section that generates a first voltage level and a second voltage level different from the first voltage level that represent a first gray scale level, respectively; and an adjusting section that adjusts the first voltage level so that a first difference between the first voltage level and a reference level is a first predetermined level, and adjusts the second voltage level so that a second difference between the second voltage level and the reference level is a second predetermined level different from the first predetermined level, wherein the first voltage level is transmitted through a first image signal line and a third image signal line of a plurality of image signal lines during a first period, the second voltage level is transmitted through a second image signal line of the plurality of image signal lines during the first period, and the second image signal line is adjacent to the first image signal line and the third image signal line.

9. A driving method for driving an electro-optic device by outputting m channel (m is a natural number greater than or equal to 2) data signals by a serial-to-parallel conversion of serial data signals, the driving method comprising:

generating a first voltage level that represents a first gray scale level and a second voltage level different from the first voltage level that represents the first gray scale level, respectively; and adjusting the first voltage level so that a first difference between the first voltage level and a reference level is a first predetermined level and adjusting the second voltage level so that a second difference between the second voltage level and the reference level is a second predetermined level different from the first predetermined level, wherein the first voltage level is transmitted through a first image signal line and a second image signal line of a plurality of image signal lines during a first period, the second voltage level is transmitted through a third image signal line of the plurality of image signal lines during the first period, and the second image signal line is adjacent to the first image signal line and the third image signal line.

* * * * *